United States Patent [19]

Davidson et al.

[11] 4,296,698

[45] Oct. 27, 1981

[54] BUTTON ATTACHING HAND TOOL WITH BUTTON STORAGE COMPARTMENT

[75] Inventors: Donald R. Davidson, Berkeley Heights; Walter H. W. Marsh, Fanwood, both of N.J.

[73] Assignee: The Singer Company, Stamford, Conn.

[21] Appl. No.: 167,984

[22] Filed: Jul. 14, 1980

[51] Int. Cl.[3] ..... D05B 3/14

[52] U.S. Cl. ..... 112/110; 227/68

[58] Field of Search ..... 112/110, 265.1, 111, 112/112, 104; 227/68; 223/102

[56] References Cited

U.S. PATENT DOCUMENTS

| | | | |
|---|---|---|---|
| 1,674,544 | 6/1928 | Hertelendy | 112/265.1 X |
| 2,189,067 | 2/1940 | Hlavaty | 112/265.1 |
| 2,605,943 | 8/1952 | Hoefle | 223/102 |
| 3,529,561 | 9/1970 | Hofe | 112/265.1 |
| 3,872,806 | 3/1975 | Bone | 112/104 |
| 3,875,648 | 4/1975 | Bone | 227/68 X |

*Primary Examiner*—H. Hampton Hunter

*Attorney, Agent, or Firm*—William V. Ebs; Robert E. Smith; Edward L. Bell

[57] ABSTRACT

A button attaching hand tool is provided with a box-like structure which includes a fixed and adjustable needle, and which includes a button storage compartment. A slidable shroud on the box-like structure for extricating a button and material from the needles is movable between a position in which an operator is shielded from injury by the needles and another position in which the needles are exposed for button sewing use.

10 Claims, 6 Drawing Figures

BUTTON ATTACHING HAND TOOL WITH BUTTON STORAGE COMPARTMENT

BACKGROUND OF THE INVENTION

1. Field of the Invention

The invention is directed to a hand operable tool for use in attaching buttons to a layer of fabric or other material.

2. Description of the Prior Art

Button attaching aids, of which the device shown and described in U.S. Pat. No. 2,605,943 of A. O. Hoefle, issued Aug. 5, 1952, and the device disclosed in U.S. Pat. No. 4,111,347 of A. R. Bone, issued Sept. 5, 1978 are examples, are well known. However, the presently known button attaching aids are deficient in various respects. In general, they are difficult to thread, are not readily adaptable for use with variously sized buttons, perform unreliably, and are inefficient; or they are unduly complex and costly to produce.

It is an object of this invention to provide an improved button attaching hand tool which is simply constructed, easily threaded, can be quickly and easily operated, is readily adaptable for use with various sized buttons, and performs reliably.

It is another object of the invention to provide an improved button attaching hand tool according to the preceding object having therein a storage compartment for loose buttons.

It is still another object of the invention to provide an improved button attaching tool with a slidable shroud which is operable to extricate a button and material from the tool and is disposable in a position wherein an operator is protected from injury by needles of the tool. Other objects and advantages of the invention will become apparent hereinafter.

SUMMARY OF THE INVENTION

In accordance with the invention, a button attaching hand tool is provided with a box-like structure which includes a button storage compartment. The tool includes a pair of needles, one of which is fixed in the box-like structure and the other of which can be moved therein to establish a spacing between the needles corresponding to the spacing between the holes of a button to be attached to some material with the tool. The tool further includes a shroud which is slidable on the box-like structure into an extended position wherein an operator is protected from injury by the needles, and a retracted position wherein the needles are exposed for button attaching use. Movement of the shroud into an extended position during a button attaching operation causes thread to be drawn through the button and material to which the button is being attached, and sheds the material and button from the tool.

DESCRIPTION OF THE PREFERRED EMBODIMENT OF THE INVENTION

Figure 1:
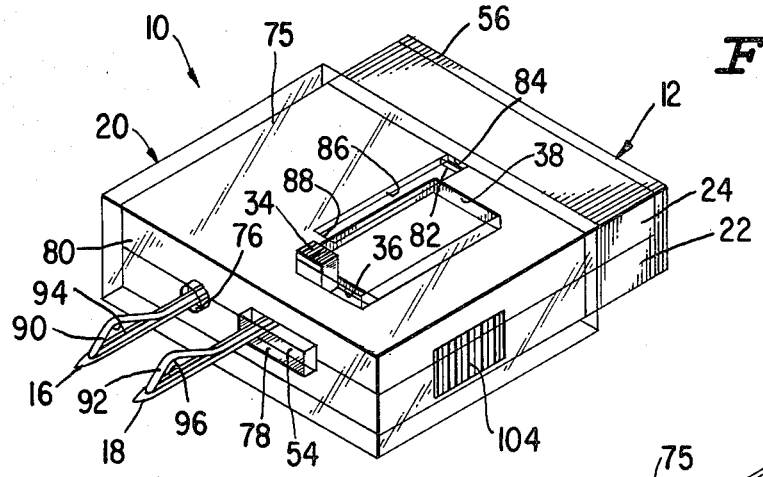
FIG. 1 is a perspective view showing the button attaching tool of the invention with a shroud thereon pulled back to expose the needles of the device.

Referring to the drawings, reference character 10 designates a button attaching tool according to the invention including a box-like structure 12 with a button carrying compartment 14, a needle 16 which is affixed in the structure 12, and a needle 18 which can be positioned in the structure to establish a distance between the needles corresponding to the distance between the holes of a button to be attached to some material with the tool. The tool further includes a shroud 20 which is used to protect persons from injury by the needles when the tool is not in use, and has an operating function hereinafter described.

The box-like structure 12 is preferably constructed from separately molded plastic parts 22 and 24. One part 22 includes a partition 26 which serves both as an end wall for button carrying compartment 14 and as one side of a guideway 28 for a slidable block 30. The other side of the guideway is formed by end wall portions 32 and 33 of box-like structure 12. Needle 18 is fixed in block 30 and is positionable relative to the needle 16 by movement of the block in the guideway. A finger engageable protuberance 34 is provided on block 30 to project through a slot 36 in part 24 and an opening 38 in shroud 20 such that it may be used by an operator of the tool to position the block. Block 30 engages the sides of the guideway 28 with a fit which, although permitting an operator to position the block without the application of undue finger pressure on protuberance 34, is effective to prevent the block from sliding out of a selected position during handling of the tool. As shown, needle 16 is fixed in a block 44 which is confined to an unalterable position between partition 26 and end wall portions 32 and 33 in a recess 46.

The parts 24 and 22 of the box-like structure 12 are preferably provided with depending pegs 48 and peg receiving holes 50 respectively, and are preferably joined with the use of conventional ultrasonic welding techniques. As shown, needles 16 and 18 project through a hole 52 and slot 54 respectively in one end of box-like structure 12. A plastic cap 56 at the other end of structure 12 includes a slot 58 through which buttons 60 can be inserted into compartment 14. The cap has a friction fit on side edges 62 and 64 of a rim 66 thereon with inside edges of the side walls of structure 12, as for example, at 68 and 70 respectively on side walls 72 and 74 of part 22. The cap can therefor be readily removed from the rest of the structure to permit easy access to buttons within compartment 14.

Figure 2:
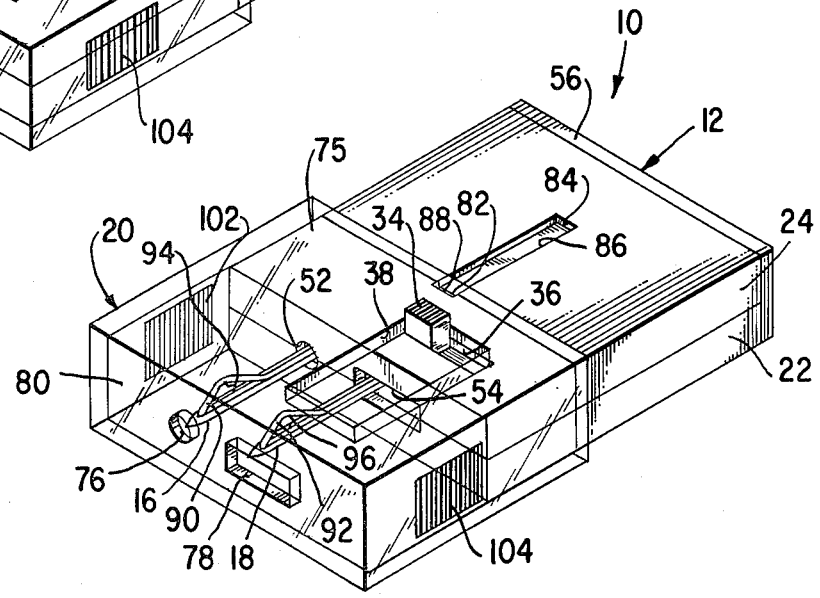
FIG. 2 is a view similar to FIG. 1, but with the shroud advanced to cover the needles.
Figure 3:
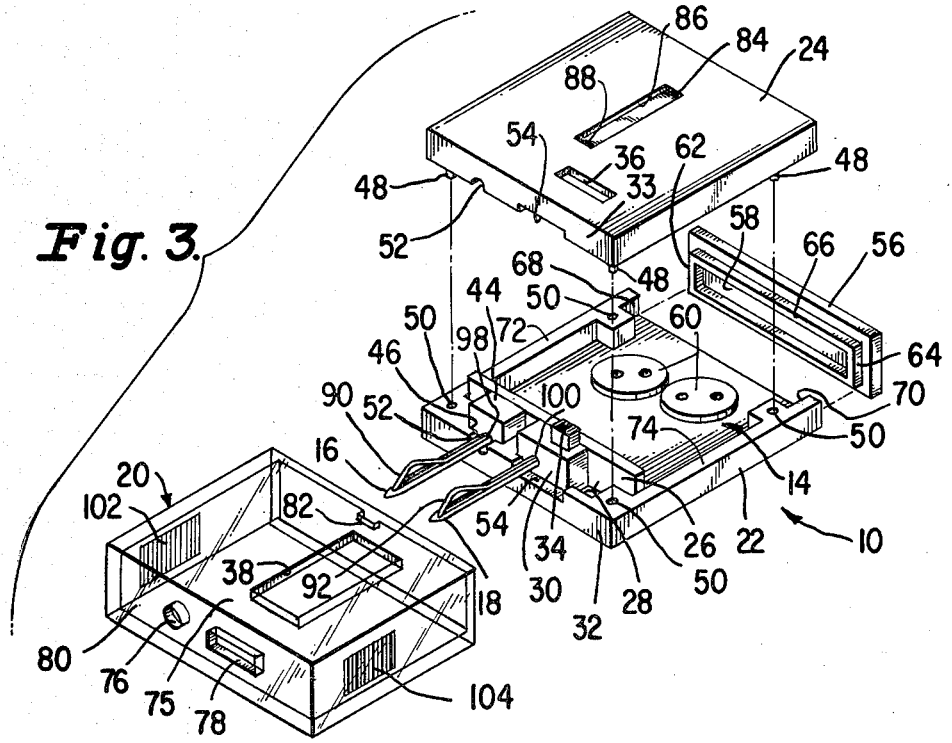
FIG. 3 is an exploded perspective view of the button attaching tool.

Shroud 20 is slidable on box-like structure 12 and includes in addition to the opening 38 in a top panel 75, a hole 76 and slot 78 in a front panel 80 for the needles 16 and 18, respectively. The shroud, which is preferably of clear plastic, is movable on structure 12 between a position wherein a tab 82 on the underside of the shroud's top panel engages one end 84 of a slot 86 in structure 12, and a position wherein the tab 82 engages the opposite end 88 of the slot. In the position of the shroud where tab 82 engages end 84 of slot 86 (retracted position), the needles are exposed (see FIG. 1), whereas in the position of the shroud where tab 82 engages end 88 of the slot (extended position), the shroud extends out from the box-like structure 12 beyond the points of the needles to shield a person from possible injury by the needles (see FIG. 2).

Needles 16 and 18 include wires 90 and 92 respectively which form collapsible and expandable eyes 94 and 96 capable of receiving and holding thread bundles. The wires 90 and 92 are affixed near the needle points, but have free end portions 98 and 100 slidable in the blocks wherein the needles are secured. The needles may be constructed and secured in blocks 44 and 30 in a manner as disclosed in the copending patent application of D. Davidson and W. Peterson for "Button Attaching Tool" (Ser. No. 145939, filed 5-2-80) assigned to The Singer Company.

An operator readies the button attaching tool 10 for a button attaching operation by first moving the shroud 20 to its retracted position with the application of finger pressure on ridged areas 102 and 104, and then moving block 30 with finger pressure on protuberance 34 as required to establish a spacing between the needles 16 and 18 corresponding to the spacing between the holes 106 and 108 of a button 110 which is to be attached to a piece of material 112. The needles 16 and 18 are pushed by the tool through the material 112 until the wire formed eyes 94 and 96 have passed therethrough. As the needles penetrate the material, pressure of the material on the wires 90 and 92 causes the free end portions of the wires to slide in the blocks 30 and 44, and the eyes 94 and 96 contract to pass freely through the material 112. Once the material is beyond the eyes 94 and 96, the eyes expand to trap and prevent the material from accidentally lifting off the needles projecting through it.

Figure 4:
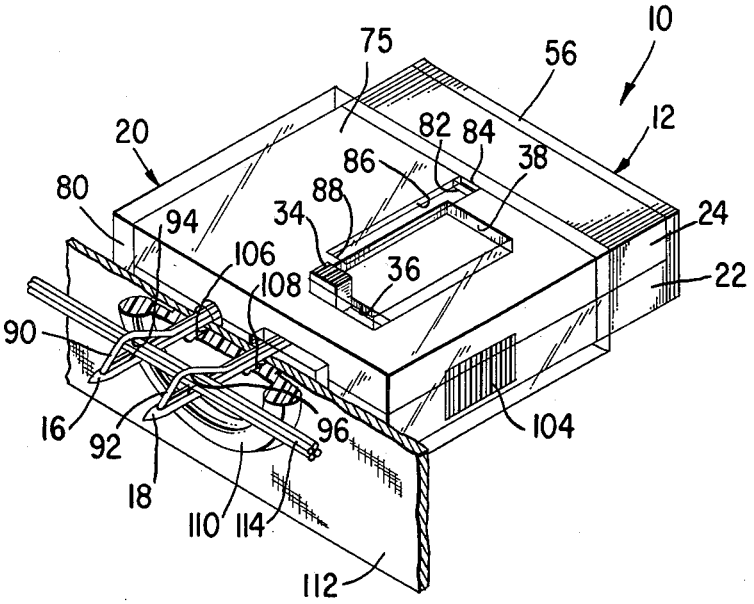
FIGS. 4 and 5 are perspective views illustrating the operation of the tool during a button attaching operation.
Figure 5:
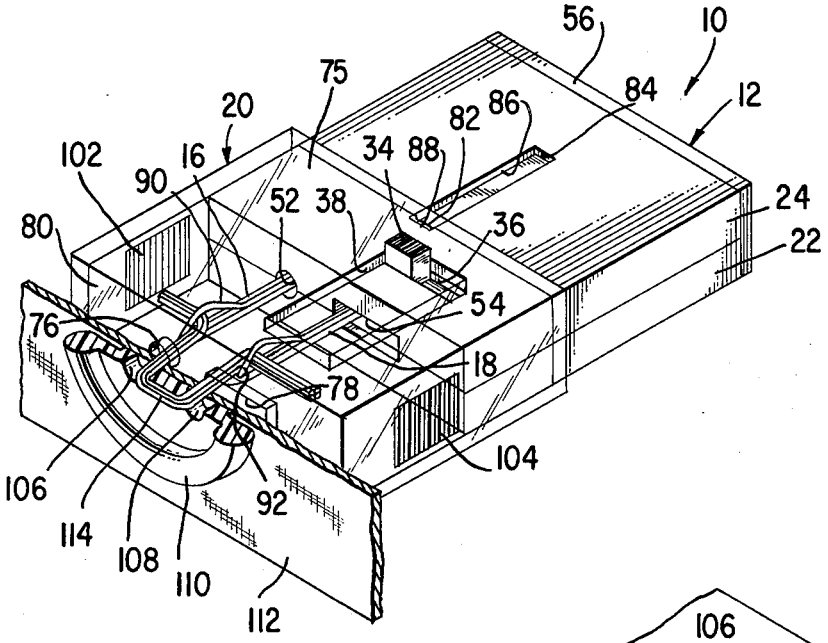
Figure 6:
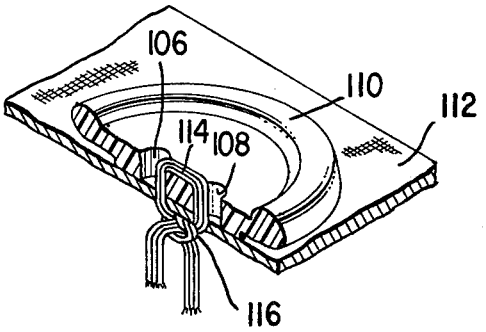
FIG. 6 is a perspective view showing a button after having been attached to a piece of material with the tool.

While the needles are projecting through the material 112, button 110 is disposed with holes 106 and 108 in alignment with needles 16 and 18 respectively, and moved onto the material 112 so as to cause the needles to penetrate the button through the holes therein and project beyond the button. The wire formed eyes 94 and 96 contract to permit easy passage through the holes 106 and 108, and expand to fully open positions as the button assumes a position against the material 112 (see FIG. 4). In the fully open position of the wire formed eyes, accidental separation of the buttons from the material 112 is effectively prevented by the wires. While the button is on the material, a bundle of threads 114 is threaded through the eyes 94 and 96 where it is held temporarily. The shroud 20 is then pushed to its extended position to shed the button and material from the needles, and cause the thread bundle 114 extending through the wire formed eyes of the needles to be pulled by the needles through holes 106 and 108 as well as through the material 112. As the button and material are extricated from the needles, the wire formed eyes temporarily contract and pass through the holes of the button and material without difficulty. Following removal of the button and material from the needles, end portions of the thread bundle may be tied into a knot 116 to permanently secure the button to the material (see FIG. 6), after which loose hanging thread ends would be cut away. A drop of adhesive may be added to the knot, or an adhesive alone may be used in place of a knot in the thread bundle to secure the button to the material.

The tool of the invention can be used, if desired, with shank buttons as well as the more conventional type button shown in the drawings. If a shank button has only a single button hole, it can be conveniently attached to a material as by first having the needles pierce the material and then placing the shank with the hole therein between the wire eyes of the needle, after which the wire eyes and hole in the button would be hand threaded. The material and button would then be stripped from the tool and the thread tied.

It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

We claim:

1. A button attaching hand tool including a box-like structure with a button storage compartment, a needle affixed in said structure, a second needle movable in said structure, means for adjusting the position of the second needle in said structure relative to the fixed needle to establish a spacing between the needles corresponding to the spacing between the holes of a button to be attached to a piece of material with said tool, and a slidable shroud on the box-like structure for use in removing the material and button from the tool, the shroud being slidable between one position wherein the shroud shields an operator from injury by the needles and another position wherein the needles are exposed for button attaching use.

2. The combination of claim 1 wherein the box-like structure and shroud are clear plastic parts through which contents of the storage compartments are visible.

3. The combination of claim 1 wherein the means for adjusting the position of the second needle includes a slidable block to which the second needle is affixed, and wherein said box-like structure includes a guideway for the block.

4. The combination of claim 3 including a finger engageable protuberance on the slide block for use in positioning the block in the box-like structure, and openings in the box-like structure and in the shroud through which the protuberance projects to an operator accessible position.

5. The combination of claim 1 including stop means on the box-like structure and shroud for defining the said one and another position of the shroud.

6. The combination of claim 5 wherein the stop means on the box-like structure and shroud includes a tab on one such part engageable with the ends of a slot provided in the other.

7. The combination of claim 1 wherein the box-like structure includes a removable cap at one end.

8. The combination of claim 7 wherein the cap is a friction fitted part of the box-like structure.

9. The combination of claim 1 wherein the needles include wire formed eyes for receiving thread bundles.

10. The combination of claim 9 wherein the wire formed eyes are collapsible and expandable.

* * * * *